US010155324B2

(12) United States Patent
Schlosser et al.

(10) Patent No.: US 10,155,324 B2
(45) Date of Patent: Dec. 18, 2018

(54) CUTTER HEAD FOR CUTTING MATERIALS, AND CUTTER THEREFOR

(71) Applicant: LEITZ GMBH & CO. KG, Oberkochen (DE)

(72) Inventors: Robert Schlosser, Wendling (AT); Franz Häupl, Neumarkt i. Hr. (AT); Christoph Galeithner, Altschwendt (AT); Erich Maier, Andorf (AT)

(73) Assignee: LEITZ GMBH & CO. KG, Oberkochen (DE)

( * ) Notice: Subject to any disclaimer, the term of this patent is extended or adjusted under 35 U.S.C. 154(b) by 82 days.

(21) Appl. No.: 15/509,085

(22) PCT Filed: Oct. 9, 2015

(86) PCT No.: PCT/DE2015/000496
§ 371 (c)(1),
(2) Date: Mar. 6, 2017

(87) PCT Pub. No.: WO2016/055044
PCT Pub. Date: Apr. 14, 2016

(65) Prior Publication Data

US 2017/0291322 A1 Oct. 12, 2017

(30) Foreign Application Priority Data

Oct. 10, 2014 (DE) ..... 10 2014 015 199

(51) Int. Cl.
*B27G 13/10* (2006.01)

(52) U.S. Cl.
CPC ..... *B27G 13/10* (2013.01)

(58) Field of Classification Search
CPC ..... B27G 13/10; B27G 13/04; B27G 13/12; B23C 5/2243; Y10T 407/1938; Y10T 407/2284; Y10T 407/194; Y10T 407/1906
See application file for complete search history.

(56) References Cited

U.S. PATENT DOCUMENTS 1,611,298 A 12/1926 Wilderson
5,647,699 A * 7/1997 Martin ..... B23C 5/207 144/230

(Continued)

FOREIGN PATENT DOCUMENTS

CH 682470 9/1993
DE 2221479 5/1972

(Continued)

*Primary Examiner* — Will Fridie, Jr.
(74) *Attorney, Agent, or Firm* — Andrew M. Calderon; Roberts Mlotkowski Safran Cole & Calderon, P.C.

(57) ABSTRACT

A cutter includes a cutting edge, a rear, a cutting surface, a foot and a longitudinal axis, as well as a transverse axis, wherein a stop surface is provided on the rear pointing towards the cutting edge. The stop surface extends in the direction of the transverse axis and is provided at an angle (alpha) of between 92° and 112° in relation to the longitudinal axis. In addition, the cutter is suitable for use in a cutter head having a carrier body, in which at least one radially outwardly open recess is provided for receiving a cutter and a clamping jaw which can be actuated by a clamping screw, and by means of which the cutter can be clamped in a fixed position in the recess. The recess has a stop with a stop surface that is directed radially inwards, and the cutter can be introduced into the recess against the force of at least one elastic element. The cutter can be applied, in a radially outward direction, by its stop surface to the stop surface that is directed radially inwards, by an elastic element.

19 Claims, 8 Drawing Sheets

(56) References Cited

U.S. PATENT DOCUMENTS

| | | | | |
|---|---|---|---|---|
| 5,904,193 | A * | 5/1999 | Kellner | B27G 13/04 144/218 |
| 6,004,079 | A * | 12/1999 | Kislinger | B27G 13/04 144/230 |
| 6,279,444 | B1 * | 8/2001 | Kellner | B27G 13/04 83/663 |
| 7,517,178 | B2 * | 4/2009 | Martin | B27G 13/10 144/230 |
| 8,729,844 | B2 | 5/2014 | Feng et al. | |
| 2005/0067051 | A1 | 3/2005 | Knappett et al. | |
| 2009/0245947 | A1 | 10/2009 | Turcot et al. | |
| 2010/0319810 | A1 * | 12/2010 | Patsch | B27G 13/10 144/235 |
| 2017/0028583 | A1 * | 2/2017 | Eckert | B27G 13/04 |

FOREIGN PATENT DOCUMENTS

| | | |
|---|---|---|
| DE | 2713118 | 10/1978 |
| DE | 3043146 | 7/1982 |
| DE | 9303186 | 5/1993 |
| DE | 19813084 | 12/1998 |
| DE | 602005001956 | 5/2008 |
| EP | 0652816 | 7/1993 |
| EP | 0821637 | 2/1998 |
| EP | 1074357 | 2/2001 |
| EP | 2148768 | 2/2010 |
| WO | 2008138326 | 11/2008 |

* cited by examiner

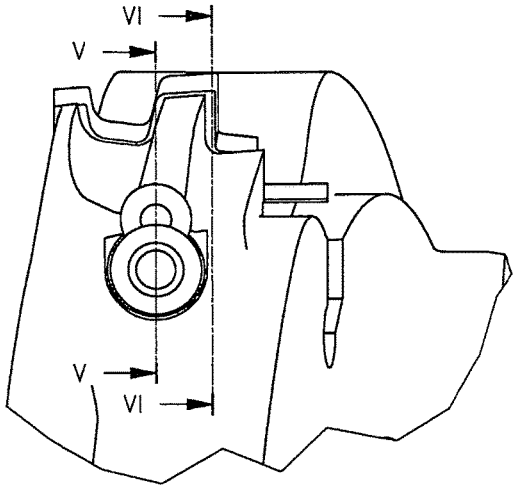
Fig. 4
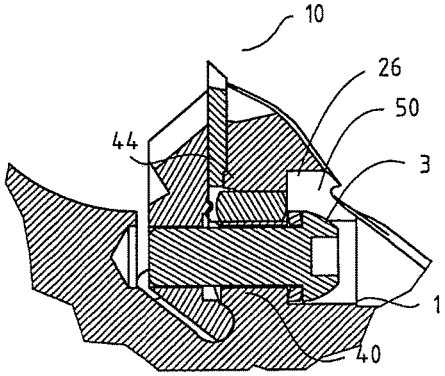
Fig. 5
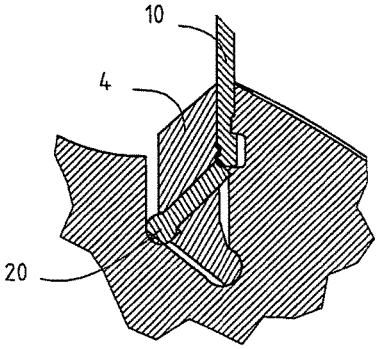
Fig. 6 ( 2:1 )

CUTTER HEAD FOR CUTTING MATERIALS, AND CUTTER THEREFOR

FIELD OF THE INVENTION

The invention relates to a cutter head for the subtractive processing of materials, in particular timber materials, plastics, light-metal materials, and/or composite materials, having a holder body in which at least one clearance that is open in a radially outward manner for receiving a cutter and clamping jaw that is activatable by way of a tensioning screw and by means of which the cutter is fixedly clampable in the clearance are provided, wherein the clearance has a detent having a radially inwardly directed detent face and the cutter is insertable into the clearance counter to the force of at least one elastic element. The invention moreover relates to a cutter for use in this cutter head.

DISCUSSION OF BACKGROUND INFORMATION

Such a cutter head is known from EP 1 074 357 A2, for example. Such cutter heads are used for processing, for example producing, profiles, solid timber and timber materials. The cutter is screwed to a clamping plate, the spring acting on the latter and impinging the clamping plate against the circumference of the holder body. A latching protrusion which engages in a groove in the clearance and comes to bear on the radially outer wall of the latter is provided on the clamping plate. In principle, pre-positioning of the cutter is indeed possible, but said pre-positioning is not precise for two reasons. There are tolerances in the radial direction, on account of the cutter being screwed to the clamping plate. Moreover, the latching protrusion that is provided on the clamping plate bears in a fully planar manner on the radially outer wall of the groove that is provided in the clearance. This bearing face is overdetermined. Pre-positioning cannot be precise due to the overdetermination and the tolerances.

In the case of the cutter head known from EP 0 652 816 B1, the cutter is placed into the clearance and by way of a groove that is provided on the chip surface of said cutter engages in a rib that is provided on the clamping jaw. The clamping jaw is pivoted toward the cutter by rotating the tensioning screw, upon further tensioning pulling the cutter radially inward such that the positioning of the cutter is performed in a radially inward manner. The cutter is fixed in the clearance by only a friction fit. No positioning of the cutter in the radial direction is performed by way of the rib, the rib rather assuming a pure securing function if and when the friction-fit connection between cutter and clearance becomes inadequate as a result of an insufficient tensioning force.

DE 30 43 146 A1 discloses a cutter head in which the cutter is inserted into a clearance in the clamping jaw. The clamping jaw is displaced in the tangential direction by means of the tensioning screw. Herein, a transverse groove that is provided on the chip face of the cutter engages in a rib that is provided in the clearance on the holder body. The cutter upon further tensioning, by way of a wedge shape of the clamping jaw, is pulled radially outward against the rib in the holder body such that positioning of the cutter is performed in a radially outward direction.

The blade of the cutter is extremely sharp such that the operator has to take utmost care when inserting the cutter in order to preclude any risk of injury. Positioning of the cutter in the case of the known cutter heads is performed by the movement of the clamping jaw alone. Should the cutter not be exactly aligned to the clearance or to the clamping jaw, respectively, said cutter can be distorted in its seat such that no optimal positioning of the cutter is performed in the radial direction. Manual positioning of the cutter on the detent is associated with an increased risk of injury on the blade.

DE 27 13 118 A1 discloses a cutter in which a groove extends across the entire length. Depressions which can be utilized when the cutter is clamped in the cutter head are provided in addition to the groove.

DE 198 13 084 C1 discloses a cutter head in which the clamping jaw in order for the cutter to be positioned is biased by a compression spring. The clamping jaw has to be displaced in a radially inward manner, counter to the force of the compression spring, in order for the cutter to be retrieved.

In the case of the cutter head known from EP 0 821 637 B1, the cutter is initially placed in a retaining strip which is then by means of the compression jaw is pressed against a detent strip which is disposed in a form-fitting manner in the holder body. A spring is disposed between the retaining strip and the compression jaw. Positioning of the cutter in the cutter head is performed in a radially outward manner.

EP 2 148 768 B1 discloses a cutter head in which the clamping jaw is configured so as to be resilient in the direction toward the cutter. By way of the resilient configuration the cutter in the region of its blade is also fixedly clamped in its seat even when by virtue of post-processing or by virtue of production tolerances there are deviations in terms of the planarity of the bearing faces of the cutter. Moreover, inaccuracies which can arise when the blade element is inserted in an oblique manner, or when the holder body has deformations as a result of prolonged use, are moreover compensated for by the resilient configuration.

SUMMARY OF THE INVENTION

Proceeding from this list of issues, the cutter head mentioned at the outset is to be improved such that simple and secure positioning of the cutter in the holder body is possible, and in particular such that pre-positioning of the cutter in the holder body is improved.

In order for the object to be achieved, a cutter head of the generic type is distinguished in that the cutter has a radially outwardly directed detent face which in relation to a longitudinal axis runs at an angle of 92° to 112°, and the cutter by way of the detent face thereof is placeable by the elastic element in a radially outward direction against the radially inwardly directed detent face.

By way of this design of the cutter head it is possible for the cutter to be inserted into the clearance by hand, to be slightly pushed against the bottom, and for the cutter herein to be pivoted such that the detent face that is configured thereon comes to superimpose the detent in the clearance. Should the cutter be let go, it self-actingly impacts the detent such that said cutter is pre-positioned in a precise manner and by way of the clamping jaw has then only to be fixedly clamped and no longer pre-positioned. The tolerances are dispensed with in the absence of a screw connection of the cutter to a detent plate. Instead of a contact area a contact line (punctiform stress) is established by way of the oblique position of the detent face in relation to the detent that is provided in the clearance in the holder body, such that there is no overdetermination and the cutter can be pre-positioned without tolerances. Cutting speeds in excess of 120 m/s are possible by way of the form-fitting and friction-fitting connection of the cutter in the clearance. In the case of conventional tools to date, maximum cutting speeds in a range from 80 to 90 m/s are possible. The positioning of the cutter in a radially outward direction moreover ensures that no radial displacement of the cutter can arise as a result of the high centrifugal forces in the case of comparatively high cutting speeds, that is to say in the case of high revolutions of the tool.

The angle is preferably 92° to 110°, in particular 95±2°, and particularly preferably exactly 95°.

If and when the cutter is provided with a groove which interacts with at least one protrusion that is provided on the clamping jaw, the cutter by way of pressure on the clamping jaw can be brought into the pre-positioned position of the former, on account of which a risk of injury when inserting the cutter is further reduced.

The detent in the cutter head can be configured on a protrusion that is provided in the clearance and/or on a groove wall.

The detent face on the cutter is preferably a wall of a groove that is disposed in the cutter. However, the detent face can also be provided on a shoulder that is provided on the cutter. The detent face can also be configured on at least one radially outwardly directed protrusion on the shoulder.

The elastic element is preferably an elastomer element and can be attached to the cutter or to the clamping jaw. It is also possible for the element to be connected to the tensioning screw and to this end for a disk that is placed onto the tensioning screw to be preferably used. Not only the cutter but also the clamping jaw is preferably positioned by way of the elastomer element, such that the cutter is subjected to pre-positioning conjointly with the clamping jaw.

A cutter for use in a cutter head that is designed according to the invention and has a blade, a spine, a chip surface, a base, a longitudinal axis and a transverse axis is distinguished by a detent face on the spine that points in the direction of the blade, extends in the direction of the transverse axis (transverse direction), and in relation to the longitudinal axis runs at an angle of 92° to 112°, preferably 92° to 110°, in particular 95°±2°, and particularly preferably exactly 95°.

The detent face is preferably configured on a shoulder that projects from the spine. The shoulder can be a lower lip of a groove that projects beyond the spine, for example. The cutter in this case has a cross section that is substantially L-shaped.

However, the detent face can also be configured on at least one protrusion that is disposed on the shoulder and points in the direction of the blade. The detent face is preferably configured so as to be spherical.

A slot that emanates from the base and runs in the direction of the blade and that is open toward the spine and the chip surface can be provided for play-free axial tensioning of the cutter.

A groove that runs in the direction of the transverse axis is preferably provided in the chip surface in order for the cutter to be connected to the clamping jaw for assembly. In order for the cross section of the cutter to not be excessively reduced, the groove that is provided in the chip surface in relation to the groove that is provided in the spine is preferably offset in the longitudinal direction. In particular, the spacing of the groove in the chip surface from the base is smaller than the spacing of the detent face in the groove in the spine from the base.

The cutter can be configured as a composite cutter. The blade in this instance is preferably configured on a plate which is connected to a blade holder. The plate and the blade holder are composed of dissimilar materials. The plate on which the blade is configured is composed of a higher-grade material than the blade holder, preferably of a higher-alloyed steel, of a sintered material, of diamond, or a hard coating is provided on the plate.

The cutter can preferably be composed of a sintered material. In this instance, the spine of said cutter is preferably configured so as to be untreated post sintering. If and when the detent face is configured so as to be spherical, said detent face can also be embodied so as to be untreated post sintering.

Exemplary embodiments of the invention are to be described in more detail hereunder by means of a drawing.

BRIEF DESCRIPTION OF THE DRAWINGS

In the drawing:

FIG. 4 shows perspective part-illustrations of the tool;

FIG. 5 shows an enlarged part-section according to the section line V-V in FIG. 4;

FIG. 6 shows an enlarged part-section according to the section line VI-VI in FIG. 4;

DETAILED DESCRIPTION OF THE PRESENT INVENTION

Figure 1:
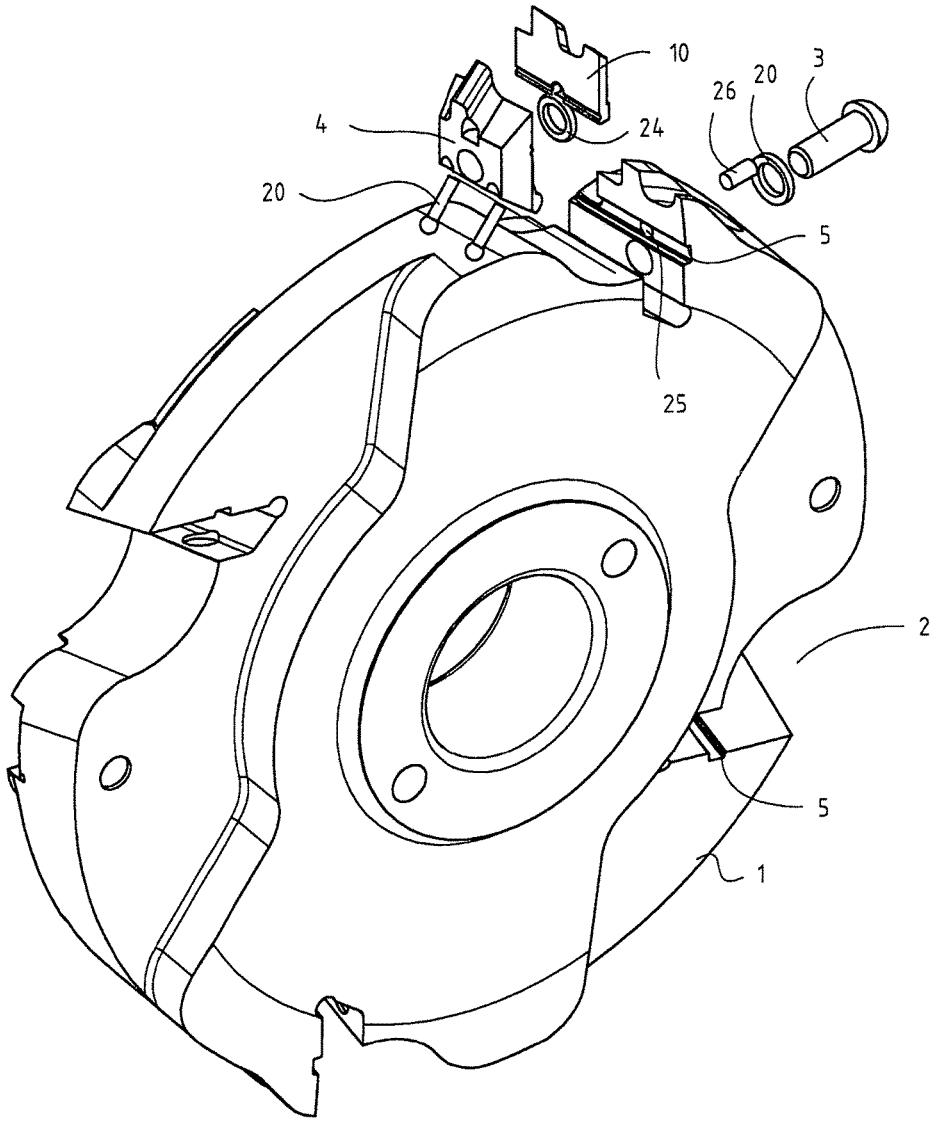
FIG. 1 shows a perspective exploded part-illustration of the cutter head.

FIGS. 1 to 5 let the construction of the cutter head by way of which in particular timber materials, plastics, or light-metal materials or composite materials, respectively, can be subtractively processed.

Said cutter head is composed of the holder body 1 in which a plurality of clearances 2 that are mutually spaced apart in a regular manner and are open in a radially outward manner are provided. In each case one cutter 10 is clamped in the clearances 2 by means of a clamping jaw 4 and a tensioning screw 3 having a washer 50 onto which an elastic disk 24 is placed. A groove 9 that runs in an axial direction A (transverse axis Q) is incorporated in the clearance 2, the radially outward wall of said groove 9 forming a detent 5 which interacts with a detent face 15 that is provided on the cutter 10. The clamping jaw 4 on the radially inward end thereof has a base 40 which sits in an undercut 8 that is incorporated in the clearance 2. The contour of the undercut 8 is adapted to the contour of the base 40. The circumferential contour of the clamping jaw 4 corresponds substantially to the profile of the cutter 10, so as to prevent a secure support of the cutter 10 during operation and any breaking away of the blade 14.

A threaded bore 41 into which the tensioning screw 3 can be screwed, and two obliquely running bores 42, 43 into each of which one elastic element 20 can be plug-fitted are provided in the clamping jaw 4. A protrusion 44 that runs in the axial direction A and interacts with a groove 19 that runs in the axial direction A in the chip surface 11 of the cutter 10 is provided on that side of the clamping jaw 40 that faces the groove 9. The groove 19 has the function of an assembly groove. Said groove 19 does not accept any retaining forces. In order for the cutter 10 to be axially positioned, a clearance 101 that emanates from the base 13 on the lower side of said cutter 10 is provided, said clearance 101 being able to be placed onto a positioning pin 26 that can be inserted into a bore 25 that is incorporated in the radial wall of the groove 9. A clearance 30 is provided in the cutter 10 to facilitate assembly when the latter is being inserted. An activation tool for the tensioning mechanism (Torx screwdriver) can be introduced axially into the clearance 30 so as to push the clamping jaw 4 radially inward, counter to the spring force of the elastic elements 20, in the case of a loosely placed cutter 10. The cutter herein by way of the groove 19 is entrained by the form fit and by way of the detent face 15 latches to the detent 5 (cf. FIGS. 7 to 10).

Figure 2:
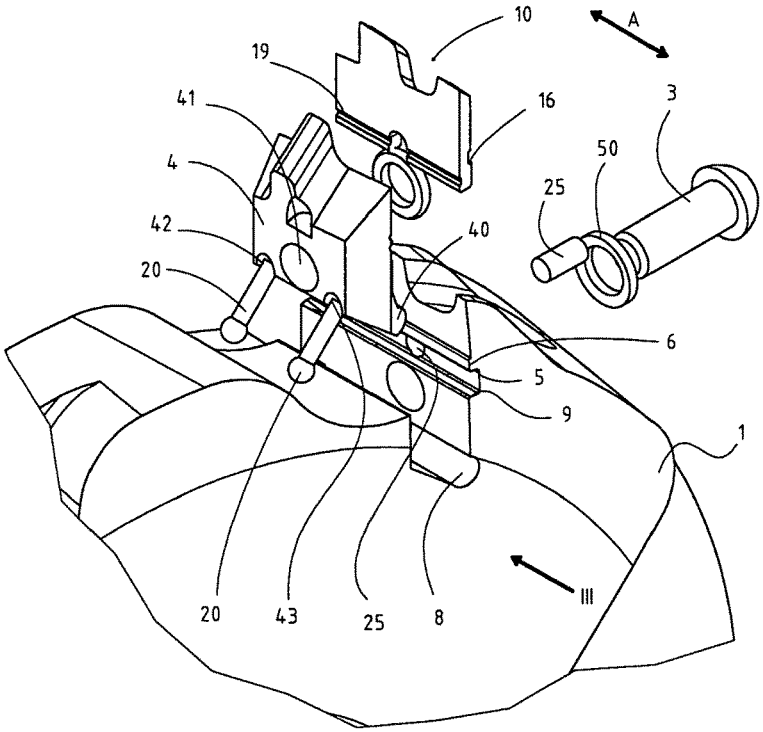
FIG. 2 shows an enlarged fragment of FIG. 1.
Figure 3:
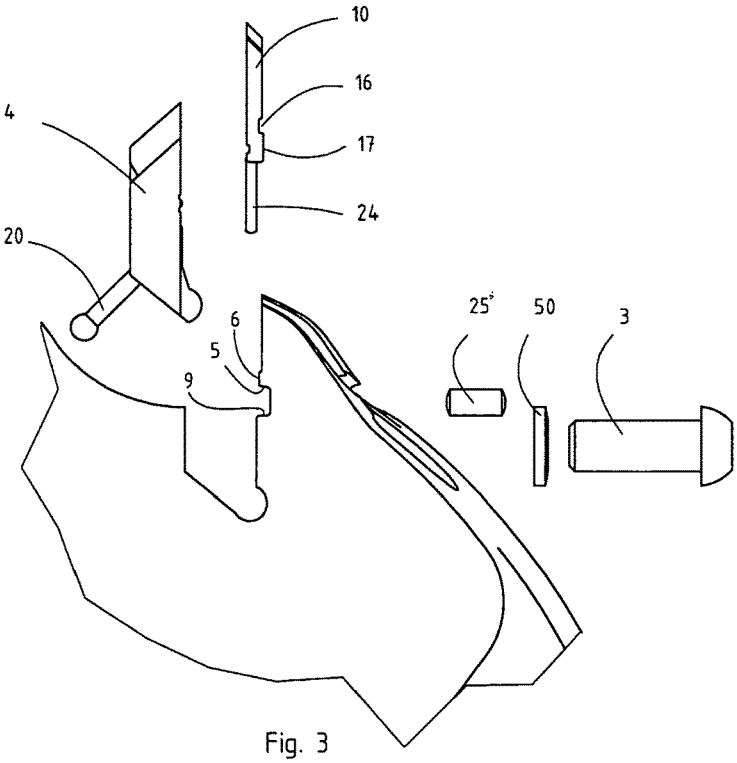
FIG. 3 shows the view according to the viewpoint arrow III as per FIG. 2.
Figure 7:
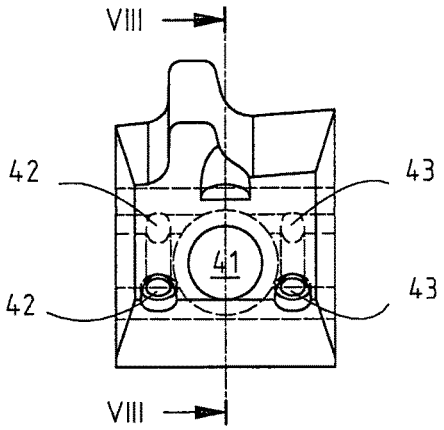
FIG. 7 shows a plan view of the clamping jaw.
Figure 8:
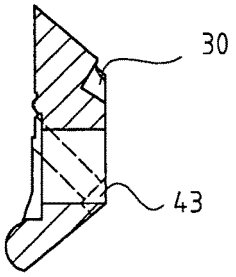
FIG. 8 shows a section through the clamping jaw along the section line VIII-VIII in FIG. 7.
Figure 9:
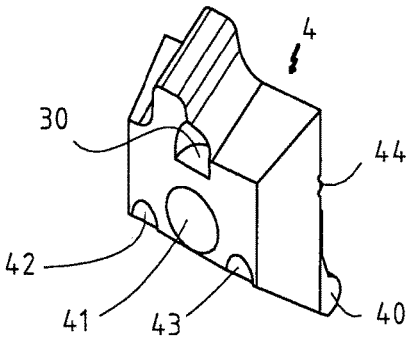
FIG. 9 shows a first perspective view of the clamping jaw.
Figure 10:
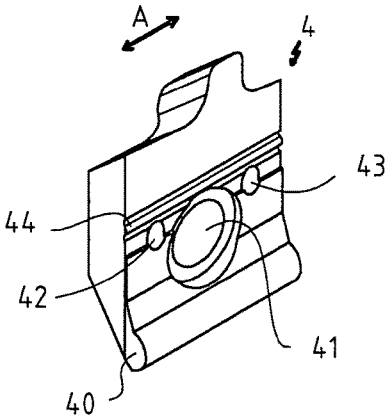
FIG. 10 shows a second perspective view of the clamping jaw.
Figure 11:
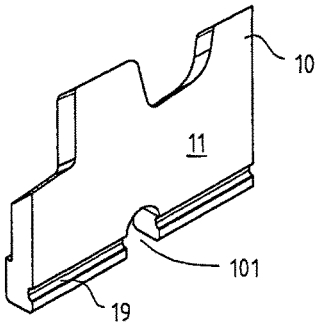
FIG. 11 shows a first embodiment of a cutter in a perspective illustration.
Figure 12:
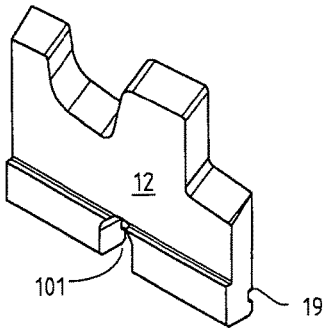
FIG. 12 shows the cutter as per FIG. 11 in another perspective.
Figure 13:
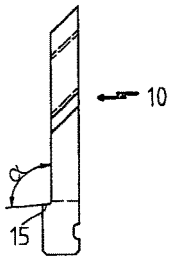
FIG. 13 shows a side view of the cutter as per FIG. 11.
Figure 14:
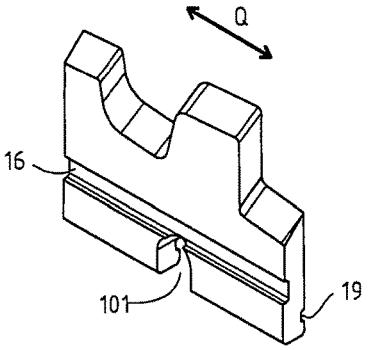
FIG. 14 shows a second embodiment of a cutter in a perspective illustration.
Figure 15:
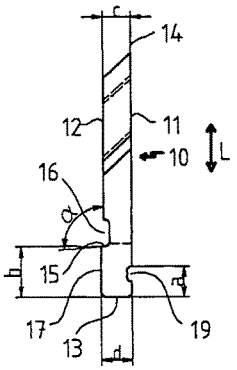
FIG. 15 shows the side view of the cutter as per FIG. 14.
Figure 16:
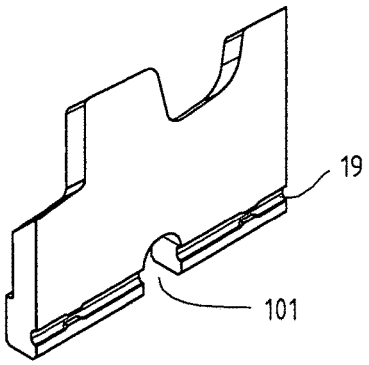
FIG. 16 shows a third embodiment of a cutter in a perspective illustration.
Figure 17:
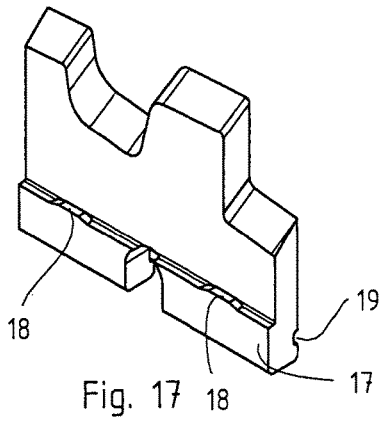
FIG. 17 shows the cutter as per FIG. 16 in another perspective.
Figure 18:
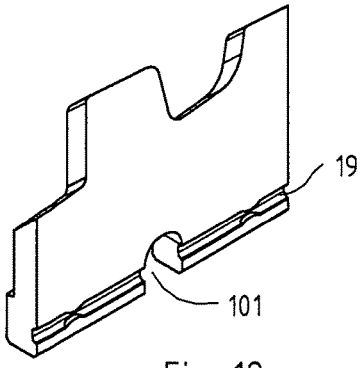
FIG. 18 shows a fourth embodiment of a cutter in a perspective illustration.
Figure 19:
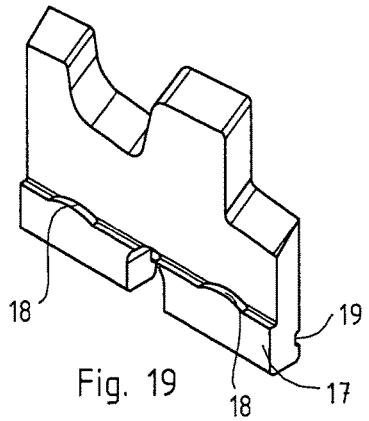
FIG. 19 shows the cutter as per FIG. 18 in another perspective.
Figure 20:
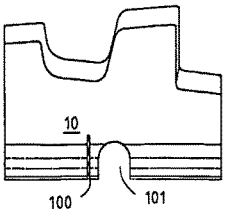
FIG. 20 shows a further embodiment of a cutter.
Figure 21:
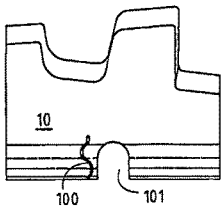
FIG. 21 shows a further embodiment of a cutter.
Figure 22:
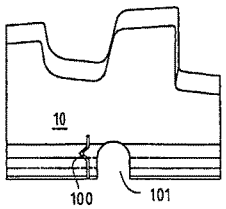
FIG. 22 shows a further embodiment of a cutter.

The cutter 10 on the spine 12 thereof that is opposite the chip surface 11 has a detent face 15 which interacts with the detent 5 that has a radially inwardly directed detent face, is configured in the clearance 2 in the holder body 1 and is provided on the upper wall of the groove 9 that runs in the clearance, or on a protrusion 6, respectively (FIGS. 2, 3). The detent face 15 can be configured on a shoulder 17 (cf. FIG. 13) or on the wall, facing the base 13, of a groove 16 that runs in the axial direction A (transverse axis Q) (cf. FIGS. 14 and 15). The detent face 15 can also be configured on protrusions 18 which are provided either on the shoulder 17 (cf. FIGS. 17 and 19) or in the lower wall of the groove 16. As is shown in FIG. 15, the thickness d of the base 13 of the cutter 10 is greater than the thickness c of the remaining cutter 10 such that the detent face 15 is configured both on the wall of the groove 16 as well as on a shoulder. A slot 100 that extends from the base 13 in the direction of the blade 14 (radial direction) and, as is shown in FIGS. 20 to 22, can have a variable profile, can be introduced so as to be directly adjacent to the clearance 101 that is provided for the axial alignment of the cutter 10, in order to be able to set an elasticity in the axial direction A in the cutter 10. The slot 100 protrudes across the full width of the cutter 10, that is to say that the former extends from the chip surface 11 to the spine 12.

Figure 23:
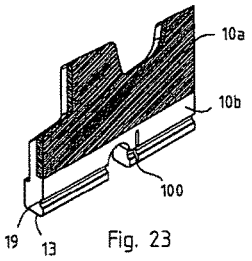
FIG. 23 shows a further embodiment of a cutter.
Figure 24:
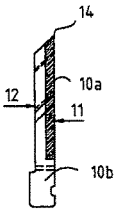
FIG. 24 shows the side view of the cutter as per FIG. 23.

The spacing a from that wall of the groove 19 that is proximal to the blade 14 to the base is smaller than the spacing b of the detent face 15 from the base 13. In principle, it is advantageous for the grooves 19 and not to run in the same plane because this would weaken the cross section of the cutter 10 to an extent that there can be a risk of breakage. If and when the groove 19 is disposed above the groove 16, the groove 19 lies so tightly on the cutting edge that the profile depth of the cutter 10 would be restricted. The detent face 15 in relation to the longitudinal axis L is inclined at an angle $\alpha$ of 90° to 110°. The angle $\alpha$ is preferably 95°. Elastic elements 23 which protrude beyond the face of the base 13 can be inserted into the base 13 (cf. FIGS. 25 and 26). As is shown in FIGS. 23 and 24, the cutter 10 can be configured as a composite part. To this end, a plate **10*a* on which the blade 14 is configured is inserted into the blade holder 10*b* and is fixedly connected, for example soldered/brazed or adhesively bonded, to the latter. The plate 10*a* is composed of a material of higher quality than that of the blade holder 10*b***. The cutter otherwise is configured as has been described above.

In order for the cutter 10 to be assembled and clamped, the latter is initially placed on the clamping jaw 4, by way of the clearance 101 of said cutter 10 is positioned in the axial direction A in relation to the positioning pin 26, and by way of the groove 19 is placed or brought to bear, respectively, on the protrusion 44 that is configured on the clamping jaw 4 (assembly groove). The base 13 of the cutter 10 herein bears on the elastic elements 20 that are plug-fitted in the bores 42, 43 and are composed of an elastomer. The elements 20 which can also be compression springs have a diameter of approximately 2 mm. The cutter 10 and the clamping jaw 4 by way of the groove 19 and the protrusion 44 are interconnected in a form-fitting manner such that the cutter 10 is conjointly pulled if and when the clamping jaw is pushed radially inward. In the case of the clamping jaw 4 being pivoted about the base 40 thereof, the detent face 15 on the cutter 10 and the detent 5 in the clearance 2 are brought into superimposition. The two elastic elements 20 which are plug-fitted in the bores 42, 43 are supported in the holder body 1 such that the clamping jaw 4 is pre-positioned conjointly with the cutter 10. It is also conceivable for only a single elastic element 20 to be used.

Figure 25:
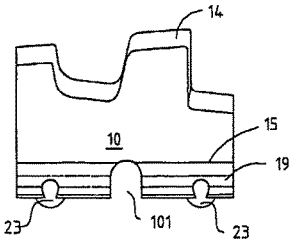
FIG. 25 shows the further embodiment of a cutter.
Figure 26:
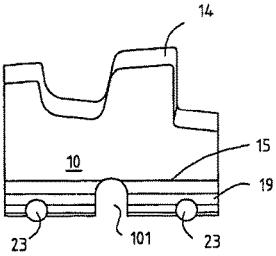
FIG. 26 shows the further embodiment of a cutter.

The elastic disk 14 that is composed of an elastomer and is plug-fitted onto the tensioning screw 3 is biased in a radially inward manner in the case of a movement of the cutter 10. If and when the clamping jaw 4 is detressed (let go), the elastic element 24 pushes the cutter 10 radially outward until the detent face 15 comes into contact with the detent 5, the cutter 10 on account thereof being positioned in a radially outward manner. The clamping jaw 4 is further pivoted by driving the tensioning screw 3 into the threaded bore 41 and fixedly clamps the cutter 3 in the clearance 2. Elastic elements 23 which are plug-fitted in the base 13 of the cutter 10 can also be used instead of the elastic elements 20 which are inserted into the bores 42, 43 in the clamping jaw 4 (FIGS. 25, 26).

Figure 27:
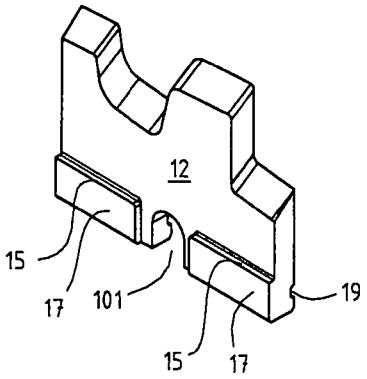
FIG. 27 shows a further embodiment of a cutter.

The detent face 15 in the case of the embodiment of a cutter 10 that is illustrated in FIG. 27 and is preferably composed of a sintered material is embodied as a protrusion and does not run continuously but is subdivided into two regions to the left and the right of the clearance 101. The detent faces 15 and the spine in one preferred embodiment are untreated post sintering. In order to ensure that defined detent regions exist on the detent face 15, the two regions of the detent face 15 are configured so as to be slightly convex (spherical).

The invention claimed is:

1. A cutter head for a subtractive processing of materials, in particular timber materials, plastics, light-metal materials, and/or composite materials therefrom, comprising a holder body in which at least one clearance that is open in a radially outward manner for receiving a cutter and clamping jaw that is activatable by way of a tensioning screw and by means of which the cutter is fixedly clampable in the clearance are provided, wherein the clearance has a detent having a radially inwardly directed detent face and the cutter is insertable into the clearance, counter to the force of at least one elastic element, wherein the cutter has a radially outwardly directed detent face which in relation to a longitudinal axis runs at an angle of 92° to 112°, and the cutter by way of the detent face thereof is placeable by the elastic element in a radially outward direction against the radially inwardly directed detent face.

2. The cutter head as claimed in claim 1, wherein the angle is 92° to 110°, in particular 95°±2°, preferably exactly 95°.

3. The cutter head as claimed in claim 1, wherein the cutter is provided with a groove which interacts with at least one protrusion that is provided on the clamping jaw.

4. The cutter head as claimed in claim 1, wherein the detent is configured on a protrusion and/or a groove wall.

5. The cutter head as claimed in one of claim 1, wherein the detent face is a wall of a groove that is disposed in the cutter, or is formed on a shoulder that is provided on the cutter.

6. The cutter head as claimed in claim 4, further comprising at least one radially outwardly directed protrusion on which the detent face is configured is provided on a shoulder that is provided on the cutter.

7. The cutter head as claimed in claim 1, wherein the elastic element is attached to the clamping jaw.

8. The cutter head as claimed in claim 1, wherein the elastic element is connected to the tensioning screw, by a disk that is placed onto the tensioning screw.

9. A cutter for use in a cutter head as claimed in claim 1, further comprising a blade, a spine, a chip surface, a base, and a longitudinal axis and a transverse axis, and wherein the detent face is on the spine that points in the direction of the blade, and which extends in the direction of the transverse axis, and in relation to the longitudinal axis runs at an angle ($\alpha$) of 92° to 112°.

10. The cutter as claimed in claim 9, wherein the angle is 92° to 110°, in particular 95°±2°, preferably exactly 95°.

11. The cutter as claimed in claim 9, wherein the detent face is configured on a shoulder that projects from the spine.

12. The cutter as claimed in claim 9, wherein the detent face is a wall of a groove that in the spine runs in the direction of the transverse axis and that is proximal to the base.

13. The cutter as claimed in claim 10, wherein the detent face is disposed on at least one protrusion that is disposed on a shoulder that is provided on the cutter and points in the direction of the blade.

14. The cutter as claimed in claim 9, further comprising a slot that emanates from the base and runs in the direction of the blade and that is open toward the spine and the chip surface.

15. The cutter as claimed in claim 9, further comprising a first groove that runs in the direction of the transverse axis and in relation to a groove that is provided in the spine is offset in the longitudinal direction is provided in the chip surface, wherein a spacing (a) of the first groove from the base is smaller than the spacing (b) of the detent face from the base.

16. The cutter as claimed in claim 9, wherein the blade is configured on a plate which is connected to a blade holder, the plate being composed of a material that is different from that of the blade holder.

17. The cutter as claimed in claim 9, wherein the former is composed of a sintered material.

18. The cutter as claimed in claim 17, wherein the spine is configured so as to be untreated post sintering.

19. The cutter as claimed in claim 11, wherein the detent face is configured so as to be spherical and untreated post sintering.

* * * * *